United States Patent [19]

Aoyama et al.

[11] 4,205,040

[45] May 27, 1980

[54] EXPOSED AGGREGATE FINISHING METHOD FOR CONCRETE

[75] Inventors: Tsuyoshi Aoyama, Hoya; Yoshimasa Hayashi, Tokyo; Hirotaka Toba, Yokohama; Akira Yoshida, Himji; Kenji Goto, Kawanishi; Motoaki Kawakama, Chiba, all of Japan

[73] Assignees: Ohbayashi-Gumi, Ltd.; Daicel Ltd.; Fujisawa Pharmaceutical Co., Ltd., all of Osaka, Japan

[21] Appl. No.: 624,833

[22] Filed: Oct. 22, 1975

[30] Foreign Application Priority Data

Oct. 22, 1974 [JP] Japan ..... 49/121790

[51] Int. Cl.[2] ..... B28B 11/22

[52] U.S. Cl. ..... 264/233; 264/338

[58] Field of Search ..... 264/338, 233; 427/133

[56] References Cited

U.S. PATENT DOCUMENTS

| | | | |
|---|---|---|---|
| 1,600,674 | 9/1926 | Kass | 264/338 |
| 1,637,321 | 7/1927 | Johnson | 264/338 |
| 3,385,919 | 5/1968 | Spence | 427/133 X |

OTHER PUBLICATIONS

Water-Soluble Resins, Ed. R. L. Davidson et al., 2nd Ed., Reinhold Book Corp., N.Y., 1968, pp. 159-163.

*Primary Examiner*—Thomas P. Pavelko
*Attorney, Agent, or Firm*—Armstrong, Nikaido, Marmelstein & Kubovcik

[57] ABSTRACT

An exposed aggregate finishing method for concrete. The method comprises coating the inside faces of a form for concrete with a cement setting retarder, drying, coating the dried faces with a synthetic organic polymer coating material which is soluble in an aqueous alkaline solution of cement, but is insoluble in water; and drying the coated faces. Alternatively, the method may be carried out by coating the inside faces of the form for concrete with the mixture of the cement setting retarder and the organic polymer coating material and drying the coated faces. Concrete is thereafter placed in the concrete form, the form removed and the surface of the molded concrete washed to make the surface rough.

3 Claims, No Drawings

EXPOSED AGGREGATE FINISHING METHOD FOR CONCRETE

SUMMARY OF THE INVENTION

This invention relates to an exposed aggregate finishing method for in-situ concrete which is easily carried out by roughening the surface or by exposing the aggregate in the concrete using a chemical solution and more specifically relates to a concrete exposed aggregate finishing method which is carried out in the following manner: First a cement setting retarder is applied to the molding faces of a concrete mold; after the retarder dries, the dried faces are covered with an organic high polymer coating material which is not soluble in water but is soluble in an aqueous solution of cement alkali; or a mixture of the setting retarder and the organic high polymer coating material is applied to the contact face and is dried; then concrete is placed in the mold and cured; and rough surface finishing work is carried out after the mold is removed.

DETAILED DESCRIPTION OF THE INVENTION

According to the conventional method for placing concrete, a hardening or setting retarder is applied to the contact face of a concrete mold before the concrete placing process; and, after concrete placing, the concrete surface is subjected to a wash-out finishing process. However, in cases of in-situ concrete, the retarder on the surface of the mold is exposed to the risk of being washed away by rainfall and the like during the formwork and before the concrete placing process. Such risk has often prohibited the application of the conventional method for exposed aggregate finishing by the treatment with liquid chemicals. Accordingly, the conventional method of the application of the retarder on the surface of the mold is limited to the surface finishing processes for concrete panels and concrete blocks which are manufactured indoors in the factory.

It is therefore a principal object of this invention to provide a method for obviating such inconvenience and making it possible to carry out rough surface finishing work with liquid chemicals in-situ concrete as well as the precast concrete panels and blocks outdoors in the factory.

In accordance with the invented method, either the surface of a retarder which is applied to the contact face of a concrete mold is protected by a coating material of an organic high polymer which is water resisting but is readily soluble in an aqueous solution of cement alkali contained in concrete and the like or a mixture consisting of the retarder and the above-mentioned coating material of organic high polymer is applied to the contact face of the mold before the concrete placing process.

Generally, the pH value of the above stated aqueous solution of cement alkali is about 10 to 11. The retarder that can be employed in carrying out the invented method is selected from the following:

(1) Aqueous solution of hydroxy carboxylic acid and their lactones and their salts.
(2) Aqueous solution of saccharides.
(3) Above aqueous solutions containing surface active agents and inorganic acids or organic acids and their salts.

(4) Aqueous solution substance such as tannin or lignin which inhibit or retard hardening or setting of concrete when used in great quantity.

The general examples of such retarders include hydroxy carboxylic organic acids and their lactones and their salts such as gluconic acid, glucono delta lactone, maleic acid, lactic acid, organic acid and their salts, lignin sulfonic acid, tannic acid and humic acid; sodium gluconate; saccharides such as glucose, fructose, saccharose, lactose, maltose, maltotriose, dextrine, glycogen, and inorganic acids and their salts such as phosphoric acid, boric acid sodium silicofluoride.

The coating material used for the protection of the retarder in accordance with this invention is a compound or mixture which is mainly composed of an organic polymer. Such a coating material is preferably selected from compounds or mixtures which can be applied in a state of water dispersion or an aqueous solution and which is insoluble in neutral or acid water but is soluble in an aqueous solution of cement alkali to provide for a continuous coating film formation. Such an organic polymer means a copolymer obtained by polymerization of organic compounds containing unsaturated groups, such as methyl methacrylate, vinyl acetate, vinyl chloride, ethylene, propylene and styrene, and an organic acid containing unsaturated groups such as acrylic acid, crotonic acid and maleic acid, or a polymer equivalent to such a copolymer, the organic polymer being adjusted to have a carboxyl group content that makes the polymer insoluble or soluble according to the above stated range of pH when a protection coating is formed with the polymer employed as a principal material.

The organic high polymer coating material may be used together with one or more kinds of additives selected as required from surface active agents, emulsion coalescing agents, thickening agents, anti-corrosives, defoaming agents, rust inhibitors and ammonia. The coating material also may be used in the form of an aqueous solution, a water dispersion or a solution in an organic solvent without departing from the true scope of the invention.

It is well known that these substances are insoluble in neutral water but are soluble in alkaline water. In accordance with this invention, two materials are selected out of these substances and they are used in combination as described in the foregoing so that the retarder which is applied to a concrete mold with the surface treatment can be retained without being washed away by rainfall, etc. which tends to take place while it is left outdoors over a long period of time during formwork or before a concrete placing process is carried out. Therefore, the rough surface of in-situ concrete by a liquid chemical treatment can be carried out easily and without fail.

The further objects, advantages and features of the present invention will become manifest in the detailed description of the following examples, wherein the term "parts" means parts by weight and "%" means percent by weight.

EXAMPLE 1

A mixture solution comprising 10 parts of sodium gluconate (I) 30 parts of water and 30 parts of an emulsion of a vinyl acetate/and/crotonic acid copolymer (95.7:4.3) (II) which emulsion has 46% solid concentration was applied to the surfaces of a concrete mold which was made of plywood of a thickness of 12 mm. The mixture solution was applied with a brush in an amount of 155 g/m². After drying the solution so applied, an ammonia aqueous solution (III) of a vinyl acetate/and/crotonic acid copolymer (97:3) of solid concentration 27% was applied 120 g/m² by means of an atomizer. After drying, the coating thus applied was exposed to flowing water for a period of more than 8 hours to check and ascertain sufficient water resistivity. Following this, concrete which was mixed with crushed stones passed through a mesh strainer of 25 mm was cast so that the coated faces of the mold contacted to the concrete. The mold was removed after curing periods of 1, 2 and 4 weeks. The surface condition of the concrete was examined and then washing finish tests were carried out with spurting water. The test results are as shown in the table below:

| Curing Period | Concrete Surface Condition | After Washing Finish Test |
|---|---|---|
| 1 week | Surface hardening was incomplete enough to permit easy washing finish work. | Coarse aggregate (crushed stones) was well fixed and depth of recessed spots ranged from 3 to 5 mm. |
| 2 weeks | Surface hardening was incomplete enough to permit washing finish with spurting water with the aid of scrubbing brush or wire brush. | Coarse aggregate (crushed stones) was well fixed and depth of recessed spots ranged 2–3 mm. |
| 4 weeks | Washing finish was hardly possible with spurting water and had to be carried out with wire brush or scrubbing brush. | Coarse aggregate (crushed stones) was well fixed and depth of recessed spots ranged 1–2 mm. |

EXAMPLE 2

Tests were carried out in the same manner as Example 1 except that the emulsion (II) was omitted and the retarder aqueous solution was applied in an amount of 85 g/m² (I). After exposure to flowing water for 8 hours, partial swelling is observed. However, the swelling disappears through drying. The test results were similar to Example 1.

EXAMPLE 3

The sodium gluconate (I) and the copolymer emulsion (II) of Example 1 are respectively replaced by glucono delta lactone (IV) and a vinyl acetate/and/crotonic acid copolymer emulsion (98:2) in this example. After drying, the ammonia aqueous solution (III) described in Example 1 was not applied and a concrete placing process was carried out to make the retarder coated mold faces directly contact the concrete. With the exception of the above, the tests of Example 3 were carried out in the same manner as in Example 1. The test results were also exactly the same as those of Example 1.

EXAMPLE 4

The same mold as that of Example 1 is used. 10 parts of (IV) is dissolved in 20 parts of a 3% CMC aqueous solution. The mixture solution thus obtained was applied to the mold with a brush to a thickness of 80 g/m². After drying, the ammonia aqueous solution (III) was applied 120 g/m² by means of an atomizer. After that, tests were conducted in the same manner as in Example 1 except that the curing period was set at 1 week. The test results were similar to those of Example 1.

What is claimed is:

1. An exposed aggregate finishing method for concrete which comprises coating the inside faces of a form for concrete with a mixture of a cement setting retarder and a synthetic organic polymer coating material which is soluble in an aqueous alkaline solution of cement, but insoluble in water, and drying the coated faces and then placing concrete into said concrete form, removing the form and washing the surface of the molded concrete to make the surface rough; the organic polymer being a copolymer of an organic compound having unsaturated groups selected from the group consisting of methyl methacrylate, vinyl acetate, vinyl chloride, ethylene, propylene and styrene, and an organic acid having unsaturated groups and selected from the group consisting of acrylic acid, crotonic acid and maleic acid.

2. An exposed aggregate finishing method for concrete which comprises coating the inside faces of a form for concrete with a cement setting retarder; drying; coating the said dried faces with a synthetic organic polymer coating material which is soluble in an aqueous alkaline solution of cement, but is insoluble in water; and drying the coated faces and then placing concrete into said concrete form, removing the form and washing the surface of the molded concrete to make the surface rough; the organic polymer being a copolymer of an organic compound having unsaturated groups selected from the group consisting of methyl methacrylate, vinyl acetate, vinyl chloride, ethylene, propylene and styrene, and an organic acid having unsaturated groups and selected from the group consisting of acrylic acid, crotonic acid and maleic acid.

3. The method of claim 2 wherein the organic polymer is a vinyl acetate/crotonic acid copolymer.

* * * * *